US005940060A

United States Patent [19]

Raynes et al.

[11] Patent Number: 5,940,060

[45] **Date of Patent: *Aug. 17, 1999**

[54] FERROELECTRIC LIQUID CRYSTAL CELL, METHOD OF CONTROLLING SUCH A CELL, AND DISPLAY

[75] Inventors: Edward Peter Raynes; Paul Bonnett, both of Oxford, United Kingdom

[73] Assignee: Sharp Kabushiki Kaisha, Osaka, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 08/537,468

[22] Filed: Oct. 2, 1995

[30] Foreign Application Priority Data

Mar. 10, 1994 [GB] United Kingdom ..... 9419899

[51] Int. Cl.[6] ..... G09G 3/36

[52] U.S. Cl. ..... 345/97; 345/89; 345/95

[58] Field of Search ..... 345/97, 89, 87, 345/94, 96, 93, 208, 147, 148; 359/54, 56; 348/790, 792; 349/33, 34

[56] References Cited

U.S. PATENT DOCUMENTS

| | | | |
|---|---|---|---|
| 4,712,877 | 12/1987 | Okada et al. | 350/350 S |
| 4,924,215 | 5/1990 | Nelson | 340/701 |
| 5,179,371 | 1/1993 | Yamazaki | 345/93 |
| 5,495,287 | 2/1996 | Kasai et al. | 345/89 |
| 5,519,411 | 5/1996 | Okada et al. | 345/89 |
| 5,583,533 | 12/1996 | Moriyama | 345/89 |

FOREIGN PATENT DOCUMENTS

| | | |
|---|---|---|
| 0256548 | 2/1988 | European Pat. Off. . |
| 0306203 | 3/1989 | European Pat. Off. . |
| 0322022 | 6/1989 | European Pat. Off. . |
| 0503321 | 9/1992 | European Pat. Off. . |
| 0510606 | 10/1992 | European Pat. Off. . |
| 0596607 | 5/1994 | European Pat. Off. . |
| 0603848 | 6/1994 | European Pat. Off. . |
| 0605865 | 7/1994 | European Pat. Off. . |
| 651719 | 2/1994 | Japan . |
| 2178582 | 2/1987 | United Kingdom . |

OTHER PUBLICATIONS

Surguy et al, Ferroelectrics, vol. 122, pp. 63–79, 1991, "The Joers/Alicy" Ferroelectrics Multiplexing Scheme.

Hughes et al, "Liquid Cystals", vol. 13, No. 4, pp. 597–601, 1993, "A New Set of High Speed Matrix Addressing Scheme for . . . ".

*Primary Examiner*—Dennis-Doon Chow

[57] ABSTRACT

A ferroelectric liquid crystal cell is controlled by applying a strobe pulse and a data pulse to the cell, the magnitude of the data pulse being modulated in order to control the resultant pulse applied to the cell. The resultant pulse includes a pre-pulse on one polarity and a main pulse of the opposite polarity. When applied to a liquid crystal cell of stepped thickness, the application of data pulses of different magnitudes switches regions of different thicknesses of the cell so as to provide grey level capability.

11 Claims, 3 Drawing Sheets

Examples of Vs and Vd pulse shapes used to address ferroelectric displays

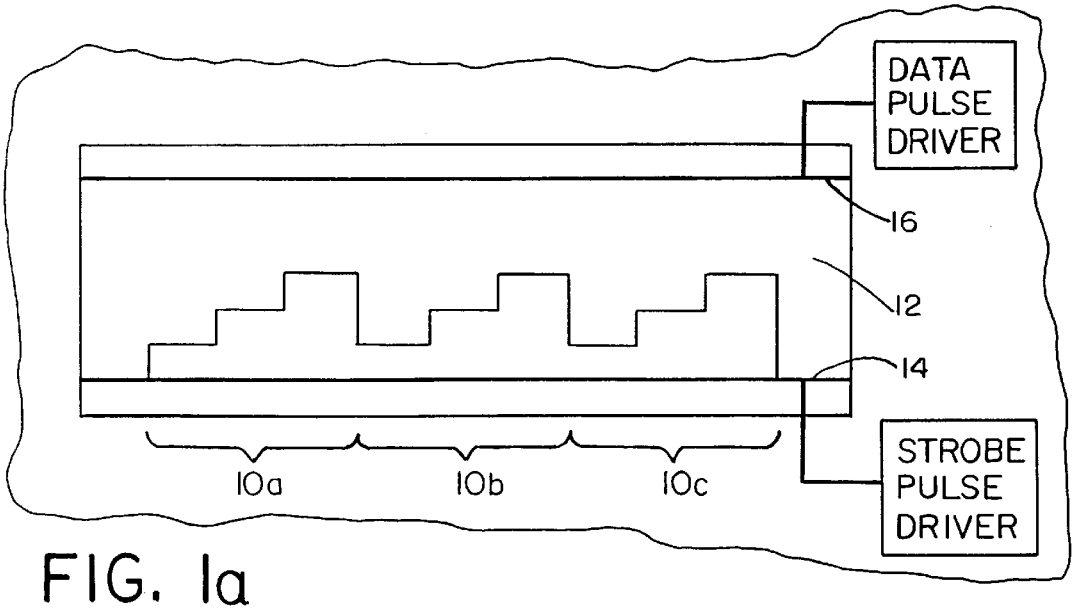
FIG. 1a
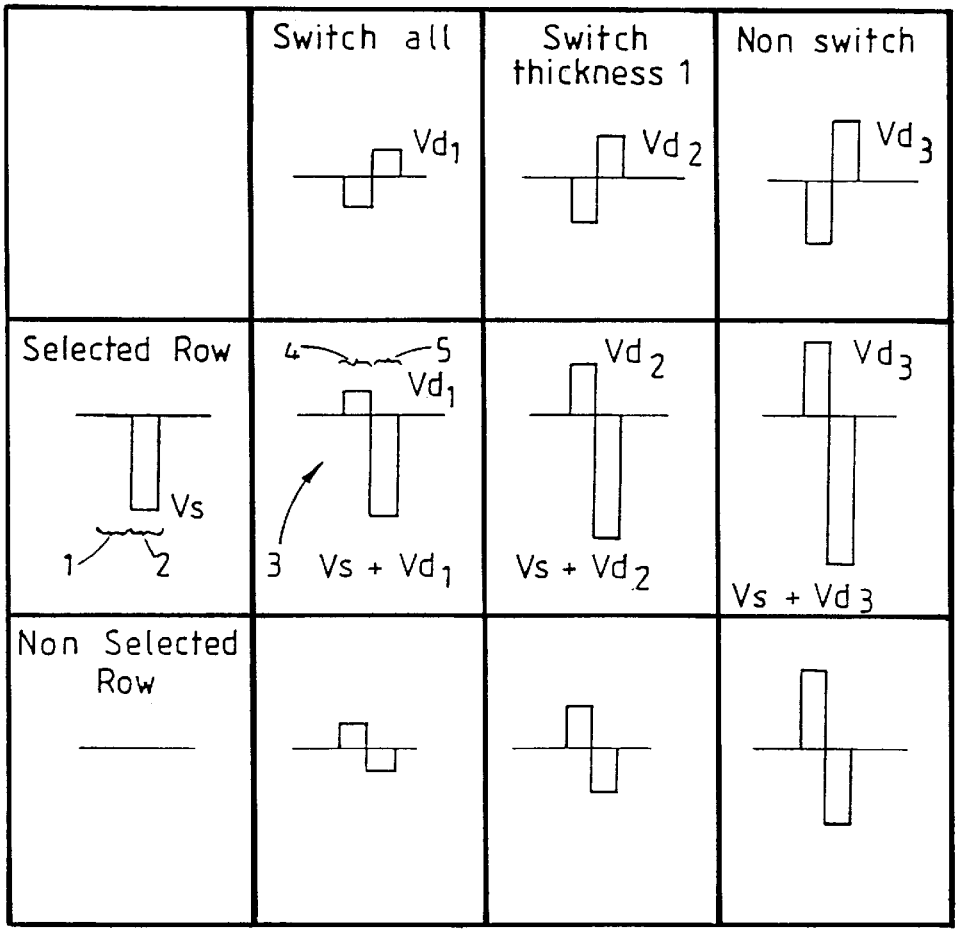
FIG. 1b Examples of Vs and Vd pulse shapes used to address ferroelectric displays Two cells of different thickness containing SCE 8. Strobe voltage = 30V. Temp. = 25°C.

Switch time vs Vs for different values of Vd applied to two cells of different thickness, filled with SF-1877

FERROELECTRIC LIQUID CRYSTAL CELL, METHOD OF CONTROLLING SUCH A CELL, AND DISPLAY

This invention relates to a ferroelectric liquid crystal cell, a method of controlling such a cell, and to a liquid crystal display (LCD) comprising a plurality of such cells.

BACKGROUND OF THE INVENTION

Two drive schemes commonly used with ferroelectric LCDs are the JOERS/Alvey scheme and the Malvern schemes. As described by PWH Surguy et al in Ferroelectrics 122, 63, 1991, the JOERS/Alvey drive scheme is for use with an LCD having a plurality of rows and columns of electrodes. A two time slot strobe pulse is applied to the rows and a data pulse is applied to the columns. One of the time slots of the strobe pulse is at zero, the other time slot having an amplitude Vs. The strobe pulse is scanned down the plurality of row electrodes.

The data pulse has an amplitude Vd and the polarity thereof may be changed between each slot.

At each pixel of the LCD, the effective applied electric field is the combination of the strobe pulse and the data pulse. In the time slot wherein the strobe pulse is zero, the magnitude of the effective electric field will be equal to Vd. However, in the other slot, the strobe and data pulses combine and depending upon their polarity, the resultant may have a magnitude greater or less than either of the strobe and data pulses. If the magnitude falls within a predetermined range, switching of the pixel occurs.

The Malvern schemes are similar to the JOERS/Alvey scheme, but instead of the strobe pulse being at zero for one time slot and at Vs for the other slot, the strobe pulse is at zero for one time slot and at Vs for several time slots. In order to distinguish between the different Malvern schemes; the schemes are identified by the number of slots over which the strobe pulse is at Vs, for example Malvern-2 denotes the scheme in which the strobe pulse is zero for one slot and at Vs for two slots. The Malvern schemes are described in Liquid Crystals 13, 597, 1993.

When used to control a ferroelectric LCD capable of displaying a plurality of grey scales, it is desirable to be able to apply a range of electric fields to the LCD. However, the above described drive schemes are intended for black and white operation.

GB-A-2 178 582 relates to a liquid crystal apparatus and driving method for addressing continuous or analogue grey levels.

SUMMARY OF THE INVENTION

According to a first aspect of the present invention there is provided a method of controlling a first multi-threshold ferroelectric liquid crystal cell comprising applying a first strobe pulse to the first cell and applying a first data pulse to the first cell, the magnitude of the first data pulse being modulated in order to control the resultant pulse applied to the first cell, the resultant pulse comprising a first time slot having a pre-pulse of a first polarity and a second time slot having a main pulse of a second polarity opposite the first polarity; wherein the first data pulse has a magnitude selected from at least three different magnitudes, the first data pulse comprising a first pulse in the first time slot of a third polarity and a second pulse in the second time slot of a fourth polarity opposite the third polarity, each of the pre-pulse and the main pulse being of rectangular shape; and the magnitude of the pre-pulse being less than the magnitude of the main pulse.

According to a second aspect of the invention, there is provided a ferroelectric liquid crystal cell including a ferroelectric liquid crystal layer, first and second electrodes, means for applying a strobe pulse to the first electrode, means for applying a data pulse to the second electrode, and means for modulating the magnitude of the data pulse in order to control the resultant pulse applied to the cell, the resultant pulse including a first time slot having a pre-pulse of a first polarity and a second time slot having a main pulse of a second polarity opposite the first polarity; wherein the first data pulse has a magnitude selected from at least three different magnitudes, the first data pulse comprising a first pulse in the first time slot of a third polarity and a second pulse in the second time slot of a fourth polarity opposite the third polarity, each of the pre-pulse and the main pulse being of a rectangular shape, and the magnitude of the pre-pulse being less than the magnitude of the main pulse.

The use of this method has the advantage that a plurality of different magnitudes of electric field may be applied to each pixel of an LCD, the magnitude of the applied field controlling the effective grey level of each pixel.

Since only one phase of data pulse is used, the use of this method has the further advantage of permitting good grey level discrimination whilst reducing pixel pattern dependence. Pixel pattern dependence occurs if data pulses of differing phases are used.

BRIEF DESCRIPTION OF THE DRAWINGS

The invention will further be described, by way of example, with reference to the accompanying drawings, in which:

FIG. 1*a* is a cross-sectional view of a display device in accordance with the present invention;

FIG. 1*b* is a diagram showing the operation of the drive scheme of an embodiment of the invention;

DETAILED DESCRIPTION OF THE INVENTION

Figure 2:
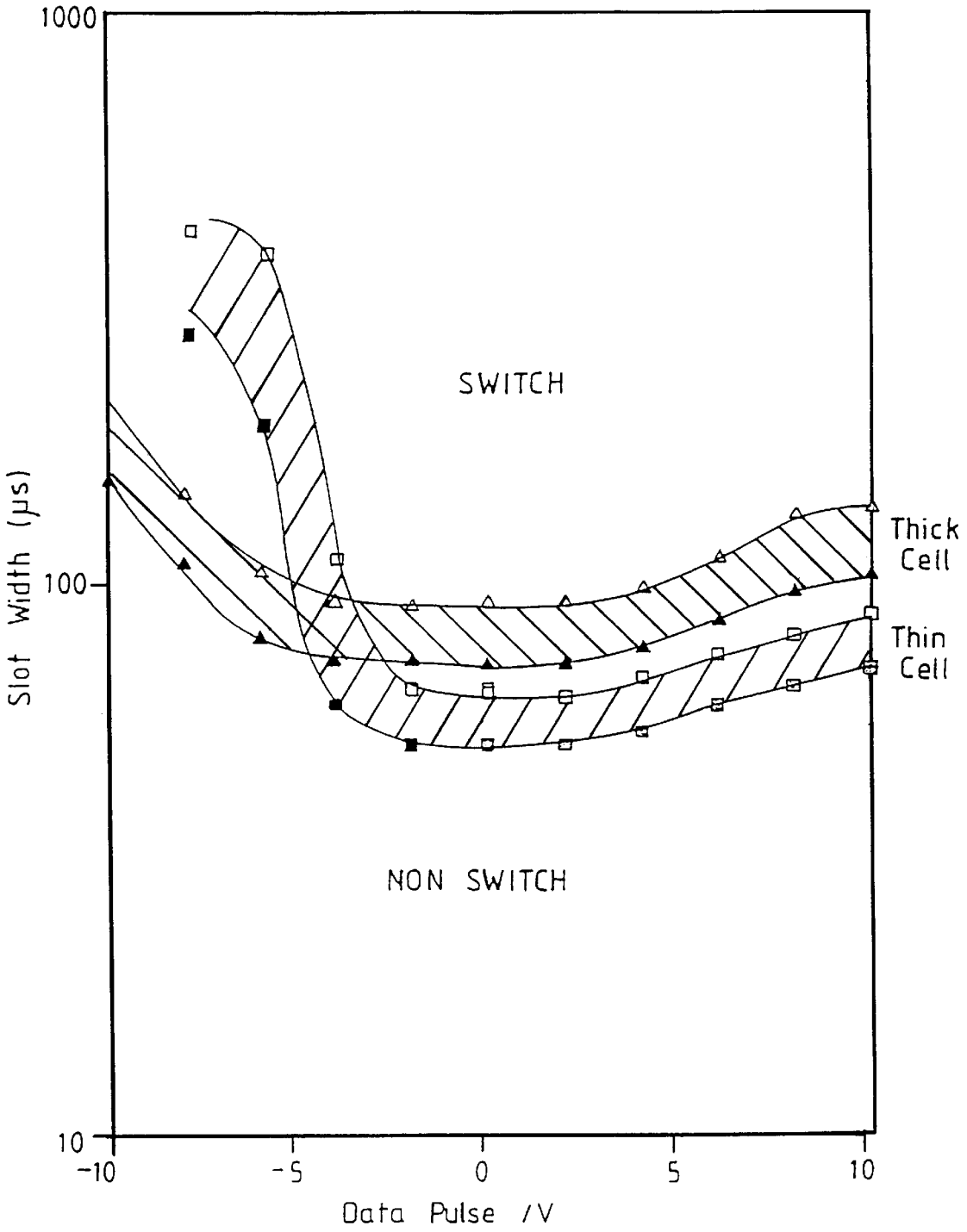
FIG. 2 is a graph of slot width vs. data voltage for two liquid crystal cells of different thicknesses.

The drive scheme described with reference to the accompanying drawings is intended to be used with a ferroelectric LCD capable of displaying a plurality of grey levels. Referring initially to FIG 1*a*, one such device comprises a liquid crystal layer, each pixel 10*a*, 10*b*, and 10*c* of which comprises a plurality of regions of different thickness of liquid crystal material 12. The voltage which must be applied to the liquid crystal material 12 in order to change the state of the material 12 is dependent upon the thickness of the liquid crystal material 12. If each pixel contains two regions of differing thickness of the liquid crystal material 12, i.e. a single step in thickness, the application of a relatively low voltage data pulse to the pixel will switch both regions of the pixel, whereas a relatively high voltage pulse data will result in none of the regions of the pixel being switched. The application of a relatively intermediate voltage data pulse will switch the thicker of the two regions of the pixel.

Of course, the drive scheme may be used with a pixel comprising four steps. It will be recognised that on applying a relatively high voltage data pulse to the pixel, only one of the four steps may be switched, the application of a lower voltage data pulse resulting in the switching of two, three or perhaps all four of the steps of a pixel. Depending upon the number of elements of each pixel which are switched on, the pixel may appear white, black or in one of several intermediate grey levels.

The ferroelectric LCD includes a plurality of such pixels arranged in rows and columns. A plurality of first electrodes 14 is arranged so that the pixels forming each row are electrically connected to one another. In addition, a plurality of second electrodes 16 is arranged to electrically connect each of the pixels forming each column.

In order to control the state of each pixel 10*a*, 10*b*, and 10*c* of the LCD, a voltage pulse is applied to the electrodes 14 and 16. Since each pixel 10*a*, 10*b*, and 10*c* of the LCD is influenced by the voltage pulse applied to the corresponding first and second electrodes 14 and 16, it will be recognised that each pixel 10*a*, 10*b* and 10*c* of the LCD may be individually addressed.

In order to control a particular pixel, a voltage pulse is applied to the first 14 electrode which is connected to that row of pixels, and that voltage pulse is known as the strobe pulse. A second voltage pulse known as the data pulse is applied to the second electrode 16 interconnecting the appropriate column of pixels.

As shown in FIG. 1*b*, where the LCD is driven using the drive scheme according to the present invention, the strobe pulse comprises a first time slot for a strobe pre-pulse 1 and a second time slot for a strobe main pulse 2, one of which is at zero potential and the other of which is at a voltage the magnitude of which is referred to as Vs. In the illustrated example, the strobe prepulse 1 is at zero potential and the strobe main pulse 2 is at a potential of magnitude Vs. The data pulse also comprises two slots, the magnitude of the pulse being equal for both of the slots, one slot being positive, and the other negative in order to DC balance the data pulse. At the addressed pixel, the resultant pulse 3 applied to the pixel is the combination of the strobe pulse and the data pulse and, as shown in FIG. 1*b*, depending upon the shape and magnitude of the data pulse, the magnitude of the resultant pulse 3 applied to the pixel is variable. Consequently, in this example, the resultant pulse 3 has a first slot for a resultant pre-pulse 4 and a second slot for a resultant main pulse 5.

In order to be able to control the different steps of the pixel, the magnitude of the data pulse applied to the appropriate second electrode is adjustable. The application of a first voltage $Vd_1$ is arranged to switch both the first and second regions of the pixel when the strobe pulse is applied to the appropriate first electrode 14. The application of a larger voltage $Vd_2$ to the appropriate second electrode 16 is arranged to switch only a first one of the steps when the strobe pulse is applied to the appropriate first electrode 14.

Figure 3:
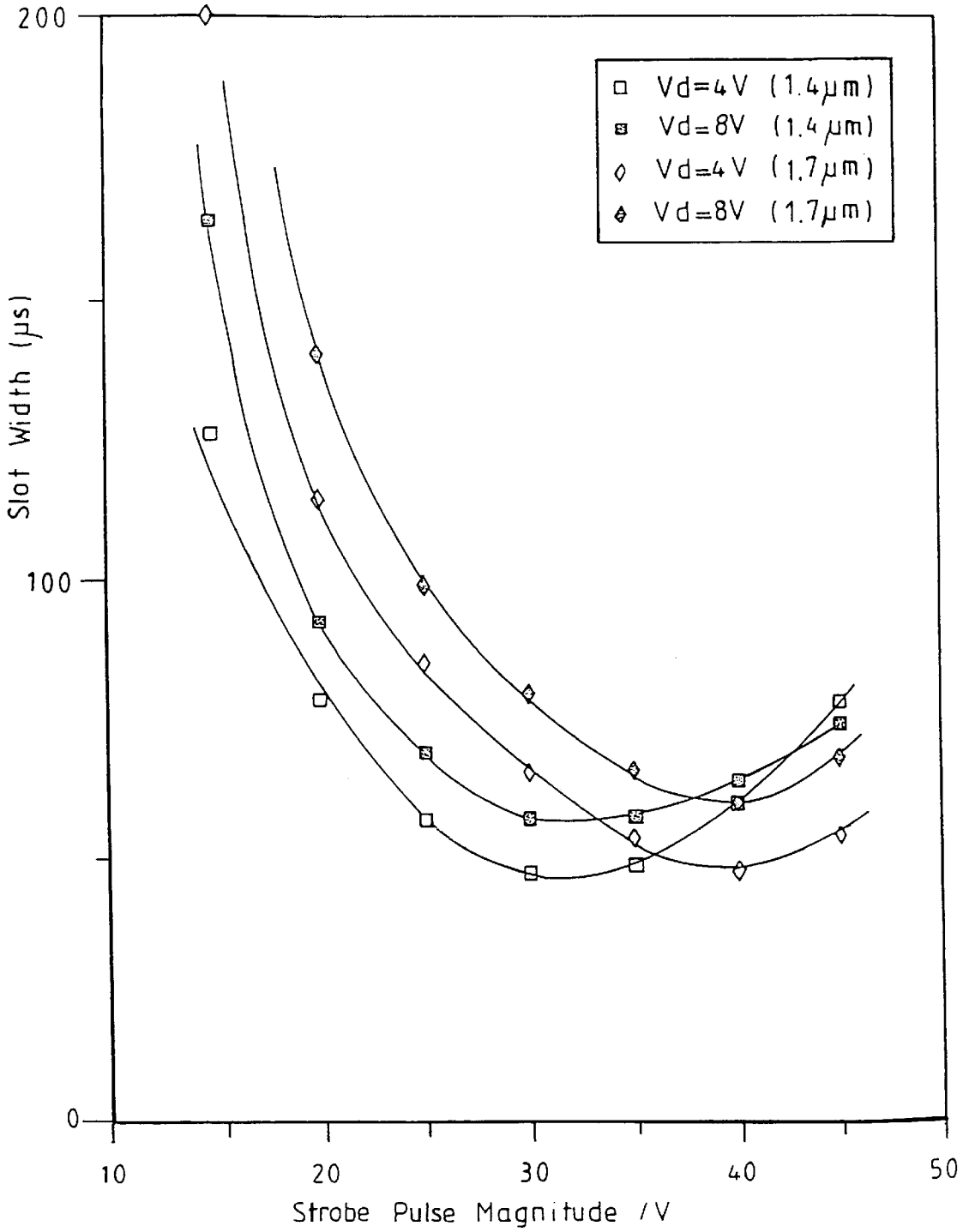
FIG. 3 is a graph of slot width vs. strobe voltage for two liquid crystal cells of different thicknesses and different data voltages.

FIGS. 2 and 3 are graphs of slot width against Vs and Vd. In FIG. 2, the curves show that, for a fixed level of Vs (in the FIG. 2 case, Vs=30 V), the magnitude of the data pulse required to switch the liquid crystal is dependent upon the thickness of the liquid crystal 12 layer. The polarity of the values of the abscissa correspond to the polarity of the pre-pulse of the data pulse. Negative values correspond to data pulses which, when applied with the strobe pulses to the addressed pixels, yield resultant pulses having pre-pulses of opposite polarity to their associated main pulses. Positive values correspond to data pulses which, when applied with the strobe pulses to the addressed pixels, yield resultant pulses having pre-pulses of the same polarity as their associated main pulses.

Consequently, negative values correspond to the pre-pulse of the resultant pulse having the opposite polarity to the main pulse of the resultant pulse. Similarly, positive values correspond to the prepulse of the resultant pulse having the same polarity as the polarity of the main pulse. Therefore, if the slot width is approximately 150 $\mu$s, the application of a data pulse of magnitude less than approximately −4 V results in switching of both a thick (1.7 $\mu$m) region and a thin (1.36 $\mu$m) region of liquid crystal material. However, on applying a data pulse of −6 V, only the thick region switches, the thin region remaining unchanged. The application of a data pulse of −10 V would result in neither region switching.

FIG. 3 also indicates that there are regions in which, for a given magnitude of strobe pulse and for a given slot width, the application of a data pulse of one magnitude will result in regions of one thickness being switched while others are unchanged, variations in the magnitude of the data pulse determining which thicknesses of liquid crystal material will be switched.

In producing the graphs of FIGS. 2 and 3, the regions comprise regions of cells having parallel rubbed alignment layers having a surface pretilt of approximately 5°.

Where the ferroelectric liquid crystal material 12 is of the type which displays a minimum in its response time-voltage characterises, as shown in FIGS. 2 and 3, it is clear that, for a particular size of time slot width, the application of a data pulse voltage of relatively low magnitude results in both the thick and thin cells being switched whereas the application of a larger magnitude data pulse for the same slot width results in only the thick cell switching, the thin cell remaining in its unswitched state.

As shown in FIG. 2, there is a band of finite width in which switching of some of the regions may occur, other regions of equal thickness not being switched. In order to control the pixels 10*a*, 10*b*, and 10*c* accurately, it is desirable not to apply electric fields falling within these bands. In FIG. 2, these bands are indicated by the shaded areas. It will be recognised that it is desirable to control the LCD using a negative data pulse, the separation of the lines of the graph of FIG. 2 being greater for negative data pulses than it is for positive values of the data pulse. Similarly it is desirable to use a strobe pulse of magnitude equal to or less than the minimum switching voltage of the material.

In order to control a display comprising a plurality of such pixels, a strobe pulse is applied to one of the first electrodes 14 and an appropriate data pulse is applied to each of the second electrodes 16. Switching of the desired one(s) of a first row of pixels is thus achieved. A strobe pulse is then applied to another of the first electrodes 14 and appropriate data pulses applied to the second electrodes 16 to achieve switching of the desired one(s) of the pixels forming a second row. This routine is repeated until each row has been switched, the routine then continuing by switching the first row and each successive row. By applying the strobe and data pulses at high speed, a substantially flicker-free display can be achieved.

The strobe pulses may be extended in a similar manner to the Malvern schemes.

The application of varying magnitude data pulses to the electrodes 14 and 16 may reduce the contrast of the display and may in some cases cause flickering. These effects are caused by the variations in the RMS voltage applied to the second electrodes. It is advantageous to reduce these differences in order to reduce the contrast and flickering problems. One method of doing this is to apply a signal to the non-selected rows of pixels using their first electrodes 14 which results in those rows of pixels being subject to an average value of the electric field rather than a varying value. For example, if two data voltages $Vd_1$, $Vd_2$ are used ($Vd_1$ and $Vd_2$. having the same phase) and pulses of magnitude $(Vd_1+Vd_2)/2$ (in phase with the data pulses) are applied to the non-selected row electrodes, the same resultant magnitude is applied to all the pixels. However, since the magnitude of the data pulse is not constant, it is not possible to compensate for this effect accurately when more than two data pulse magnitudes are in use.

An alternative method is to apply a compensating signal to all of the second electrodes 16 between every ten or so strobe pulses in order to allow the RMS voltage applied to the second electrodes 16 to be the same. Hence, the compensation signal has to be calculated for each-set of second electrodes 16 between the ten or so strobe pulses, since the voltage applied to the second electrodes 16 depends upon the data pulses applied to the respective first electrodes 14. Depending upon how often the compensating signal is applied, the display will be slowed down.

Although the preceding description relates to the control of a ferroelectric LCD which is capable of displaying a plurality of grey scale levels due to the liquid crystal layer being of varying thickness, it will be recognised that the described drive scheme could be used in LCDs in which grey scale is achieved by other means and is controlled by the application of electric fields of varying magnitude.

If the method of controlling an LCD described above is used in combination with temporal and spatial dither, a large number of grey levels can be achieved. For example, using pixels which are capable of displaying four grey levels in combination with two bits of spatial and two bits of temporal dither, a total of 256 grey levels can be achieved.

What is claimed is:

1. A method of controlling a first multi-threshold ferroelectric liquid crystal cell comprising:

applying a first strobe pulse to the first cell, the first cell including a ferroelectric liquid crystal layer having a layer of liquid crystal material of a type displaying a minimum in its response time-voltage characteristics, and applying a first data pulse to the first cell, the magnitude of the first data pulse being modulated with the polarity of the first data pulse always changing in the same manner with respect to time in order to control the resultant pulse applied to the first cell, the resultant pulse comprising a first time slot having a pre-pulse of a first polarity and a second time slot having a main pulse of a second polarity opposite the first polarity;

wherein the first data pulse has a magnitude selected from at least three different non-zero magnitudes, the first data pulse comprising a first pulse in the first time slot of a third polarity and a second pulse in the second time slot of a fourth polarity opposite the third polarity, each of the pre-pulse and the main pulse being of rectangular shape; and the magnitude of the pre-pulse being less than the magnitude of the main pulse.

2. A method as claimed in claim 1, wherein the first strobe pulse is extended in accordance with a drive scheme wherein the first strobe pulse is at zero for one time slot and at a non-zero amplitude for several time slots.

3. A method as claimed in claim 1, further comprising the steps of applying the first data pulse to a second cell, and applying a compensation strobe pulse to the second cell in order to substantially compensate for the effect of the first data pulse thereon.

4. A method as claimed in claim 1, further comprising the step of applying a second strobe pulse and a second data pulse to a second cell, the magnitude of the second data pulse being modulated in order to control the resultant pulse applied thereto, and subsequently applying a compensation data pulse to the first cell and to the second cell in order to compensate for the application of the first data pulse to the second cell and for the application of the second data pulse to the first cell.

5. A multi-threshold ferroelectric liquid crystal cell comprising:

a ferroelectric liquid crystal layer including a layer of liquid crystal material of a type displaying a minimum in its response time-voltage characteristics, first and second electrodes, means for applying a strobe pulse to the first electrode, means for applying a data pulse to the second electrode, and means for modulating the magnitude of the data pulse with the polarity of the first data pulse always changing in the same manner with respect to time in order to control the resultant pulse applied to the cell, the resultant pulse comprising a first time slot having a pre-pulse of a first polarity and a second time slot having a main pulse of a second polarity opposite the first polarity;

wherein the first data pulse has a magnitude selected from at least three different non-zero magnitudes, the first data pulse comprising a first pulse in the first time slot of a third polarity and a second pulse in the second time slot of a fourth polarity opposite the third polarity, each of the pre-pulse and main pulse being of a rectangular shape, and the magnitude of the pre-pulse being less than the magnitude of the main pulse.

6. A ferroelectric liquid crystal cell as claimed in claim 5, wherein the liquid crystal layer is of non-uniform thickness.

7. A ferroelectric liquid crystal cell as claimed in claim 6, wherein the liquid crystal layer is of stepped thickness.

8. A liquid crystal display comprising a plurality of liquid crystal cells of the type claimed in claim 7, arranged to define a plurality of rows and columns; the cells of each row being electrically interconnected by respective first electrodes, the cells of each column being electrically interconnected by respective second electrodes, and the liquid crystal layer being a continuous layer extending through each of the cells.

9. A method of controlling a multi-threshold ferroelectric liquid crystal cell having a ferroelectric liquid crystal material exhibiting a minima in its response time-voltage characteristics, comprising the steps of:

applying a first strobe pulse to the cell in combination with applying a first data pulse to the cell, the application of the first data pulse being controlled such that the polarity of the first data pulse always changes in the same manner with respect to time and the amplitude of the first data pulse is modulated such that the resultant pulse applied to the first cell comprises a first period of at least one time slot and a second period of at least one time slot, with the resultant pulse in the first period having an opposite polarity and lower magnitude than the resultant pulse in the second period.

10. A method as claimed in claim 9, wherein the first period and the second period of the resultant pulse each consist of one time slot.

11. A ferroelectric liquid crystal cell, comprising:

a ferroelectric liquid crystal material exhibiting a minima in its response time-voltage characteristics;

means for applying a first strobe pulse to the cell; and means for applying a first data pulse to the cell in conjunction with the first strobe pulse being applied to the cell, the application of the first data pulse being controlled such that the polarity of the first data pulse always changes in the same manner with respect to time, and the amplitude of the first data pulse is modulated such that the resultant pulse applied to the first cell comprises a first period of at least one time slot and a second period of at least one time slot, with the resultant pulse in the first period having an opposite polarity and lower magnitude than the resultant pulse in the second period.

* * * * *